US010767900B2

(12) United States Patent
Russell et al.

(10) Patent No.: US 10,767,900 B2
(45) Date of Patent: Sep. 8, 2020

(54) BURNER WITH FLOW DISTRIBUTION MEMBER

(71) Applicant: Lochinvar, LLC, Lebanon, TN (US)

(72) Inventors: Jennifer Marie Russell, Brush Creek, TN (US); Jesse Tyler McCaslin, Lebanon, TN (US); James Travis Adams, Lebanon, TN (US); Benjamin Paul Putnam, Watertown, TN (US)

(73) Assignee: Lochinvar, LLC, Lebanon, TN (US)

( * ) Notice: Subject to any disclaimer, the term of this patent is extended or adjusted under 35 U.S.C. 154(b) by 78 days.

(21) Appl. No.: 14/712,273

(22) Filed: May 14, 2015

(65) Prior Publication Data

US 2016/0334134 A1 Nov. 17, 2016

(51) Int. Cl.

| | |
|---|---|
| ***F24H 1/14*** | (2006.01) |
| ***F23D 14/02*** | (2006.01) |
| ***F23D 14/62*** | (2006.01) |
| ***F23D 14/36*** | (2006.01) |

(Continued)

(52) U.S. Cl.

CPC ..... *F24H 1/145* (2013.01); *F23D 14/02* (2013.01); *F23D 14/10* (2013.01); *F23D 14/36* (2013.01); *F23D 14/62* (2013.01); *F23D 14/70* (2013.01); *F23D 2203/1012* (2013.01); *F23D 2900/00003* (2013.01); *F23D 2900/14241* (2013.01)

(58) Field of Classification Search

CPC ..... F24H 1/145; F23D 14/02; F23D 14/36
USPC ..... 122/18.1
See application file for complete search history.

(56) References Cited

U.S. PATENT DOCUMENTS 1,607,183 A * 11/1926 Bundy ..... F02M 1/00 48/189.4
1,761,473 A * 6/1930 Goebel ..... F02M 1/00 138/37
2,669,297 A 2/1954 Sherman (Continued)

FOREIGN PATENT DOCUMENTS

CA 2657147 A1 9/2009
CN 1492184 A 4/2004

(Continued)

OTHER PUBLICATIONS

International Search Report and Written Opinion of corresponding International Application No. PCT/US2016/030427, dated Aug. 4, 2016, 16 pp. (not prior art).

(Continued)

*Primary Examiner* — Steven B McAllister
*Assistant Examiner* — John E Bargero
(74) *Attorney, Agent, or Firm* — Lucian Wayne Beavers; Patterson Intellectual Property Law, PC

(57) ABSTRACT

A pre-mix burner apparatus includes a burner having a generally cylindrical burner surface, the burner having a generally circular burner inlet at one end of the burner, the burner inlet having an inlet diameter. A flow distribution member is arranged to distribute flow of fuel and air mixture into the burner. The flow distribution member includes a closed axially central portion configured to block flow of fuel and air mixture axially centrally into the burner. The flow distribution member includes a plurality of vanes extending radially outward from the closed axially central portion. The vanes are configured to generate a swirling flow of fuel and air mixture flowing past the vanes into the burner.

19 Claims, 12 Drawing Sheets

(51) Int. Cl.
*F23D 14/70* (2006.01)
*F23D 14/10* (2006.01)

(56) References Cited

U.S. PATENT DOCUMENTS

| | | | | |
|---|---|---|---|---|
| 3,748,853 | A * | 7/1973 | Jones | F23R 3/14 60/737 |
| 3,975,141 | A | 8/1976 | Sweet | |
| 4,141,213 | A | 2/1979 | Ross | |
| 4,793,800 | A | 12/1988 | Vallett et al. | |
| 4,960,378 | A * | 10/1990 | Jannemann | F23D 14/34 239/432 |
| 5,197,871 | A | 3/1993 | Yamamoto et al. | |
| 5,415,539 | A * | 5/1995 | Musil | F23C 7/004 239/404 |
| 5,535,686 | A | 7/1996 | Chung | |
| 5,758,587 | A | 6/1998 | Büchner et al. | |
| 5,879,148 | A | 3/1999 | Cheng et al. | |
| 6,036,480 | A | 3/2000 | Hughes et al. | |
| 6,162,049 | A | 12/2000 | Pellizzari et al. | |
| 6,694,926 | B2 | 2/2004 | Baese et al. | |
| 6,978,619 | B2 | 12/2005 | Blomeyer | |
| 6,993,916 | B2 | 2/2006 | Johnson et al. | |
| 7,267,083 | B2 * | 9/2007 | Le Mer | F28D 7/024 122/18.1 |
| 7,824,178 | B1 * | 11/2010 | Putnam | F23D 14/36 122/134 |
| 8,814,560 | B2 | 8/2014 | Le Mer et al. | |
| 9,506,646 | B1 * | 11/2016 | Swanson | F23C 7/004 |
| 2005/0098147 | A1 | 5/2005 | Chen | |
| 2005/0227195 | A1 | 10/2005 | George | |
| 2007/0207426 | A1 | 9/2007 | Perry et al. | |
| 2007/0272132 | A1 | 11/2007 | Marx et al. | |
| 2009/0220901 | A1 | 9/2009 | Poehner et al. | |
| 2009/0241942 | A1 | 10/2009 | Schwank et al. | |
| 2010/0316965 | A1 * | 12/2010 | Le Mer | F23D 14/70 431/12 |
| 2015/0086934 | A1 | 3/2015 | Akbarimonfared et al. | |

FOREIGN PATENT DOCUMENTS

| | | | |
|---|---|---|---|
| DE | 4004778 | A1 | 8/1990 |
| DE | 9013114 | U1 | 12/1990 |
| EP | 1538395 | A1 | 6/2005 |
| EP | 1813882 | A1 | 8/2007 |
| EP | 2037175 | A2 | 3/2009 |
| EP | 2368069 | A1 | 9/2011 |
| EP | 2242952 | | 1/2015 |
| EP | 3187781 | A1 | 7/2017 |
| FR | 2476808 | A1 | 8/1981 |
| FR | 2843189 | A1 | 2/2004 |
| GB | 2070211 | A | 9/1981 |
| WO | 9416272 | A1 | 7/1994 |
| WO | 2006053542 | A1 | 5/2006 |
| WO | 2009093278 | A2 | 7/2009 |
| WO | 2010073282 | A1 | 7/2010 |

OTHER PUBLICATIONS

International Preliminary Report on Patentability dated Nov. 23, 2017, 13 pages (not prior art).
European Search Report for corresponding European application No. EP 16793184, dated Nov. 26, 2018, 8 pages (not prior art).
Office action and search report dated Sep. 9, 2019 from corresponding China Appl. No. 201680027724.2 (not prior art) (English translations provided).
Office action dated Aug. 1, 2018 in corresponding Canadian Application No. 2,982,502, 8 pages (not prior art).

* cited by examiner

BURNER WITH FLOW DISTRIBUTION MEMBER

BACKGROUND OF THE INVENTION

Field of the Invention

The present invention relates generally to burners for use in water heaters and boilers, and more particularly to a flow distribution member used with such burners for providing an improved pressure distribution of fuel and air mixture throughout the burner.

Description of the Prior Art

One well known architecture for water heaters and boilers is that utilized in the series of water heaters produced by Lochinvar LLC, the assignee of the present invention, as its POWER-FIN® water heaters and boilers. The general construction of such water heaters may be similar to that disclosed for example in U.S. Pat. No. 4,793,800 to Vallett et al. or that in U.S. Pat. No. 6,694,926 to Baese et al.

Such water heaters utilize a generally cylindrical burner concentrically received within a circular array of fin tubes.

Water heaters of this type use a premix blower to supply air and gas mixture to the cylindrical burner. One issue which is encountered in designing in such a water heater is the desire to provide a balanced uniform flow of fuel and air mixture throughout the burner, and particularly to avoid any negative pressure zones in the burner which could cause flashback into the burner.

BRIEF SUMMARY OF THE INVENTION

In one embodiment a pre-mix burner apparatus includes a burner having a generally cylindrical burner surface, the burner having a central axis and having a generally circular burner inlet at one end of the burner. The burner inlet has an inlet diameter. A flow distribution member is arranged to distribute flow of fuel and air mixture into the burner. The flow distribution member includes a closed axially central portion configured to block flow of fuel and air mixture axially centrally into the burner. The flow distribution member further includes a plurality of vanes extending radially outward from the closed axially central portion. The vanes are configured to generate a swirling flow of fuel and air mixture flowing past the vanes into the burner.

The closed axially central portion may be disc shaped and may have a disc diameter in a range from about 10 percent to about 20 percent of the inlet diameter.

The burner inlet may define an inlet plane generally perpendicular to the burner central axis, and each of the vanes may be oriented at a vane angle to the inlet plane in a range from about 30 degrees to about 60 degrees.

Each of the vanes may be planar.

Each of the vanes may be generally triangular in shape.

Each of the vanes may have a radial length in a range from about 40 percent to about 45 percent of the inlet diameter.

The array of vanes may include at least 12 and no greater than 20 vanes substantially equally circumferentially spaced about the central axis of the burner.

The flow distribution member may comprise a formed integral sheet, the vanes each being generally triangular shaped with two free sides and one attached side, the attached side extending generally radially relative to the central axis of the burner.

The flow distribution member may have a total open area in a range from about 50 percent to about 70 percent of a cross sectional area of the burner inlet.

The flow distribution member may include a plurality of spokes extending outward from the closed axially central portion, each of the vanes being attached to one of the spokes.

The flow distribution member may include a radially outer planar flange connected to radially outer ends of the spokes, the flange being configured to mount the flow distribution member.

The apparatus may further include a blower configured to provide fuel and air mixture to the burner inlet, the blower having a blower outlet having a blower outlet cross sectional area, wherein the burner inlet has an inlet cross sectional area greater than the blower outlet cross sectional area.

The vanes may be configured such that the spiral flow pattern adjacent and downstream of the burner inlet prevents flame flow back into the burner adjacent the burner inlet.

The burner apparatus may be used in combination with a water heater, the water heater being in heat exchange relationship with the burner.

In another embodiment a method is provided for operating a burner comprising:

(a) providing an inlet stream air mixture to an inlet of the burner, the inlet being generally circular;

(b) blocking an axially central portion of the inlet and thereby preventing axially central flow of the inlet stream into the inlet; and (c) swirling the inlet stream and creating a spiral flow pattern as the stream passes through an annular area between the axially central portion and a diameter of the burner inlet, such that negative pressure is avoided in the burner adjacent the burner inlet.

The method may further include in step (a) the burner being a cylindrical burner having a cylindrical burner surface and having an axial length, and in step (c) the spiral flow pattern extending along the entire length of the burner.

The spiral flow pattern may cause the fuel and air mixture to exit the burner surface at substantially uniform velocities along the entire length of the burner.

The spiral flow pattern may avoid the creation of negative pressures at any location along the entire length of the burner.

The burner may be operated at an output in excess of 1.0 MM BTU/HR.

The inlet stream of step (a) may be provided by a blower having a blower outlet with an outlet cross sectional area less than an inlet cross sectional area of the burner inlet.

The method may further comprise the step of heating water with a heat exchanger in heat exchange relationship with the burner.

Numerous objects, features and advantages of the present invention will be readily apparent to those skilled in the art upon a reading of the following disclosure when taken in conjunction with the accompanying drawings.

DETAILED DESCRIPTION

Figure 1:
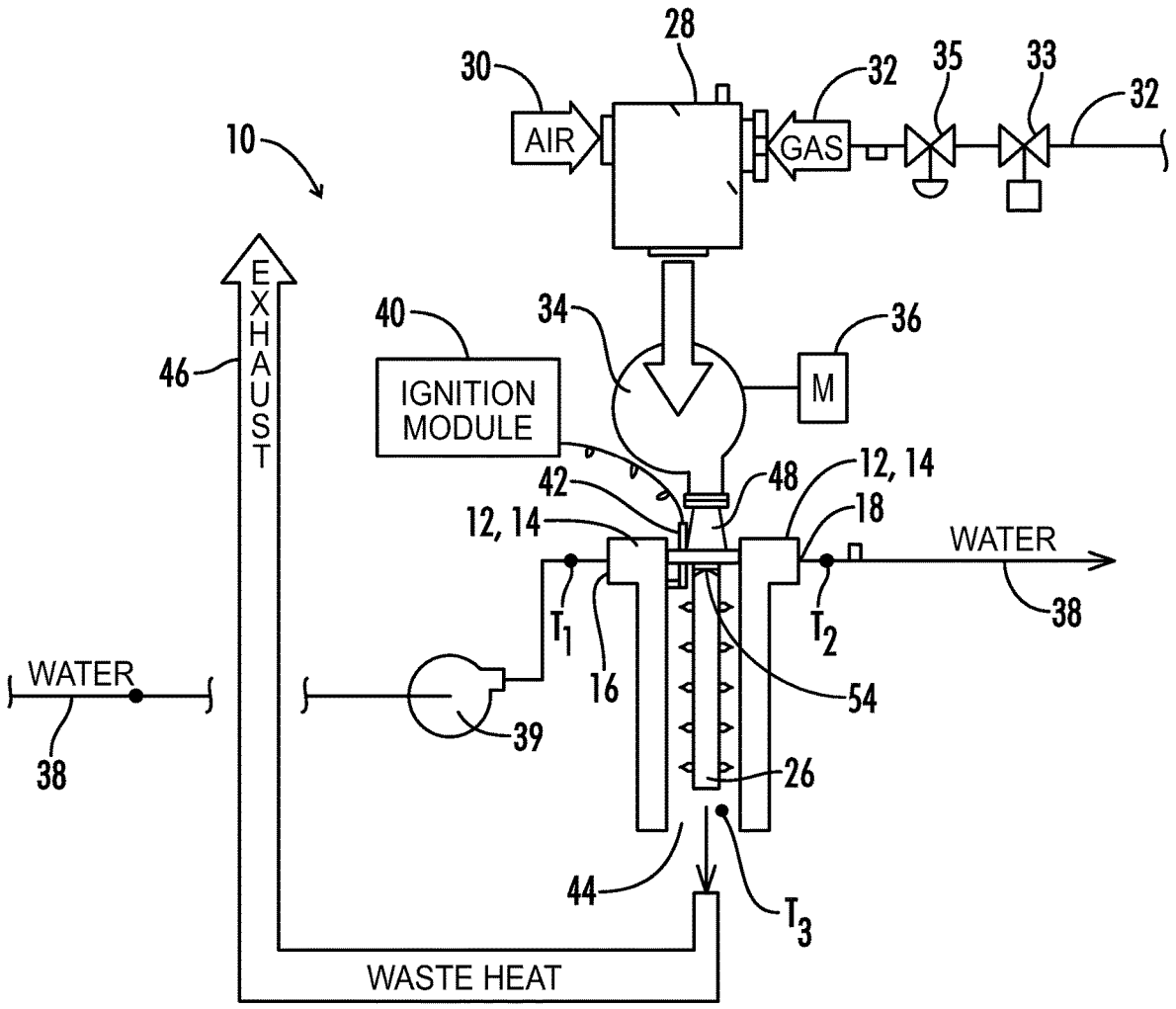
FIG. 1 is a schematic drawing of a water heater apparatus.

Referring now to the drawings, and particularly to FIG. 1, a water heater or boiler apparatus is shown and generally designated by the numeral 10. As used herein, the term water heater refers to an apparatus for heating water, including both steam boilers and water heaters that do not actually "boil" the water. Much of this discussion refers to the apparatus 10 as a boiler 10, but it will be understood that this description is equally applicable to water heaters that do not boil the water. The boiler 10 includes a heat exchanger 12 having a water side 14 having a water inlet 16 and a water outlet 18.

Figure 2:
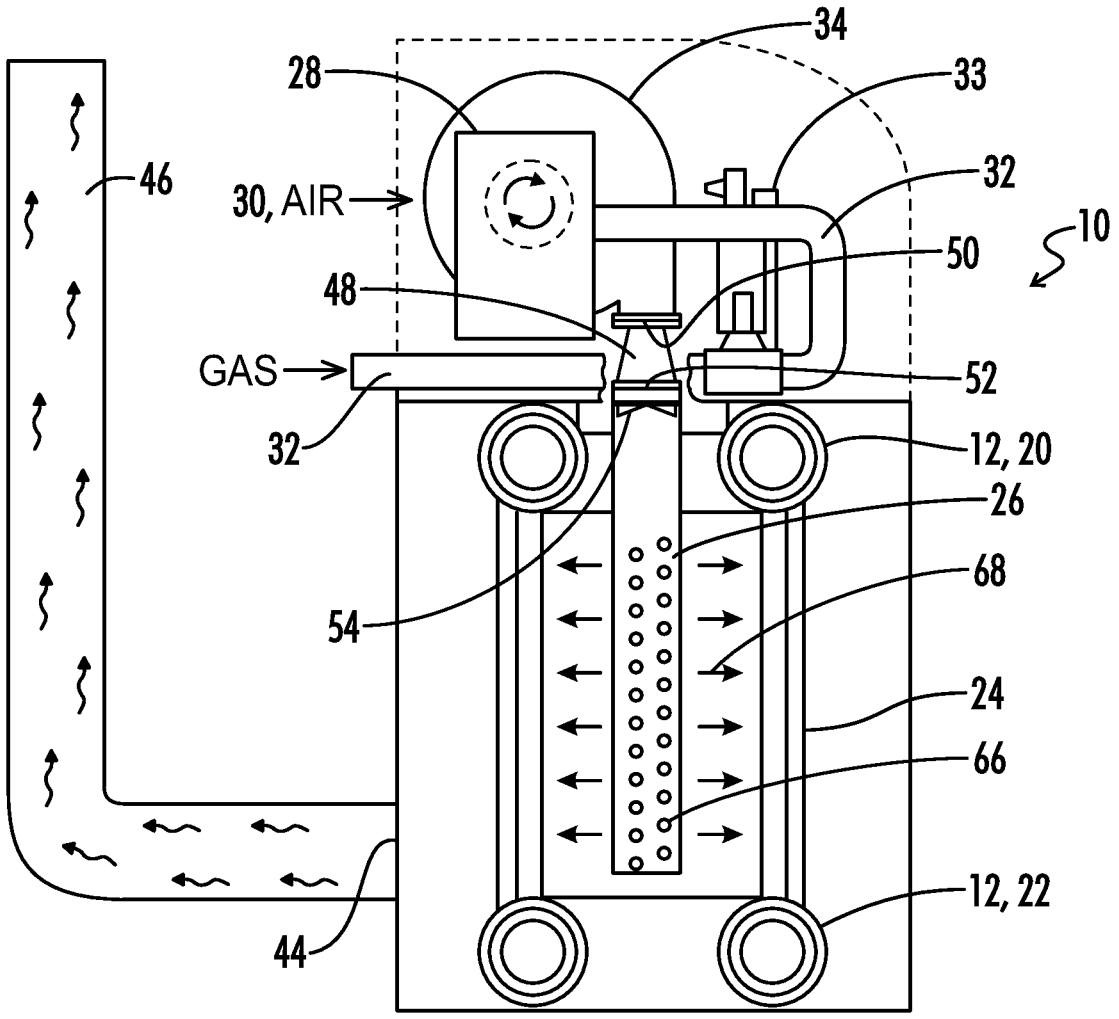
FIG. 2 is an enlarged schematic cross sectional view of the water heater apparatus of FIG. 1.

The general construction of the heat exchanger 12 may be similar to that disclosed for example in U.S. Pat. No. 4,793,800 to Vallett et al., or that in U.S. Pat. No. 6,694,926 to Baese et al., the details of which are incorporated herein by reference. The heat exchanger may be a multiple pass exchanger having a plurality of fin tubes arranged in a circular pattern with a burner located concentrically within the circular pattern of fin tubes. In FIG. 2 the heat exchanger 12 is shown to have upper and lower headers 20 and 22 connected by a plurality of vertically oriented fin tubes 24. The burner apparatus disclosed herein may also be used with other arrangements of heat exchangers.

A burner 26 is concentrically received within the circular array of fin tubes 24. The burner 26 is operatively associated with the heat exchanger 12 for heating water which is contained in the water side 14 of the heat exchanger 12. Within each fin tube 24, the water receives heat from the burner 26 that is radiating directly upon the exterior fins of the fin tubes 24.

The burner 26 is of the type referred to as a premix burner which burns a previously mixed mixture of combustion air and fuel gas. In the system shown in FIG. 1, a venturi 28 is provided for mixing combustion air and fuel gas. Other types of mixing devices may be used in place of the venturi 28. An air supply duct 30 provides combustion air to the venturi 28. A gas supply line 32 provides fuel gas to the venturi 28. A gas control valve 33 is disposed in supply line 32 for regulating the amount of gas entering the venturi 28. The gas control valve 33 includes an integral shut off valve. A shut off valve 35 may also be disposed in supply line 32.

In order to provide the variable output operation of the burner 26 a variable flow blower 34 delivers the premixed combustion air and fuel gas to the burner 26 at a controlled blower flow rate within a blower flow rate range. The blower 34 may be driven by a variable frequency drive motor 36. Alternatively, a variable speed motor with a Pulse Width Modulation drive may be used to drive the blower 34.

The gas line 32 will be connected to a conventional fuel gas supply (not shown) such as a municipal gas line, with appropriate pressure regulators and the like being utilized to control the pressure of the gas supply to the venturi 28.

The gas control valve 33 is preferably a ratio gas valve for providing fuel gas to the venturi 28 at a variable gas rate which is proportional to the flow rate entering the venturi 28, in order to maintain a predetermined air to fuel ratio over the flow rate range in which the blower 34 operates.

An ignition module 40 controls an electric igniter 42 associated with the burner 26.

Combustion gasses from the burner 26 exit the boiler 10 through a combustion gas outlet 44 which is connected to an exhaust gas flue 46.

The water inlet and outlet 16 and 18 may be connected to a flow loop 38 of a heating system. A pump 39 may circulate water through the flow loop 38 and thus through the water side 14 of the heat exchanger 12.

A plurality of temperature sensors are located throughout the boiler apparatus 10 including sensor T1 at the water inlet 16, sensor T2 at the water outlet 18, and sensor T3 at the exhaust gas outlet 44.

A blower to burner transition duct 48 may connect a blower outlet 50 to a burner inlet 52. A flow distribution member 54 may be located at the burner inlet 52.

Figure 3:
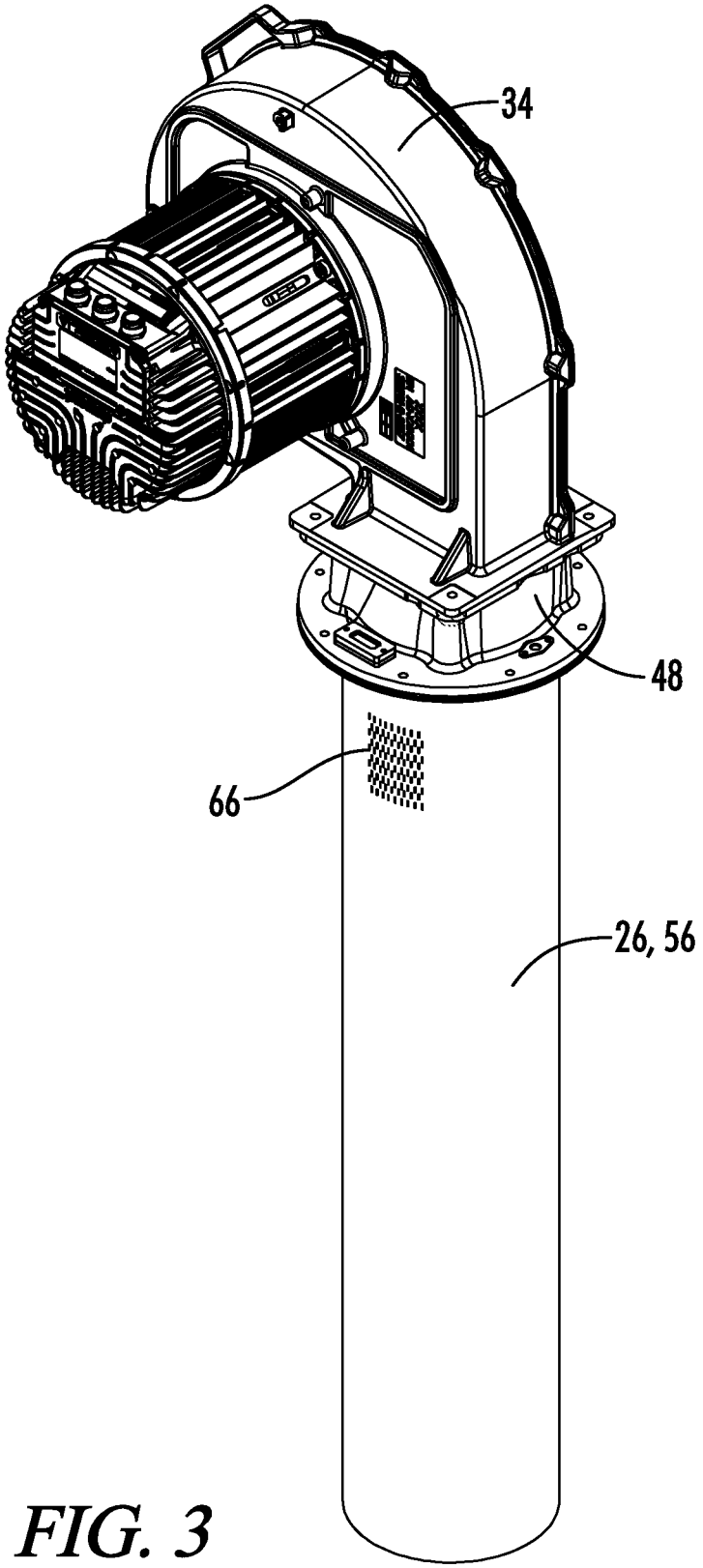
FIG. 3 is a perspective view of the pre-mix blower and the cylindrical burner utilized with the water heater apparatus of FIGS. 1 and 2.
Figure 4:
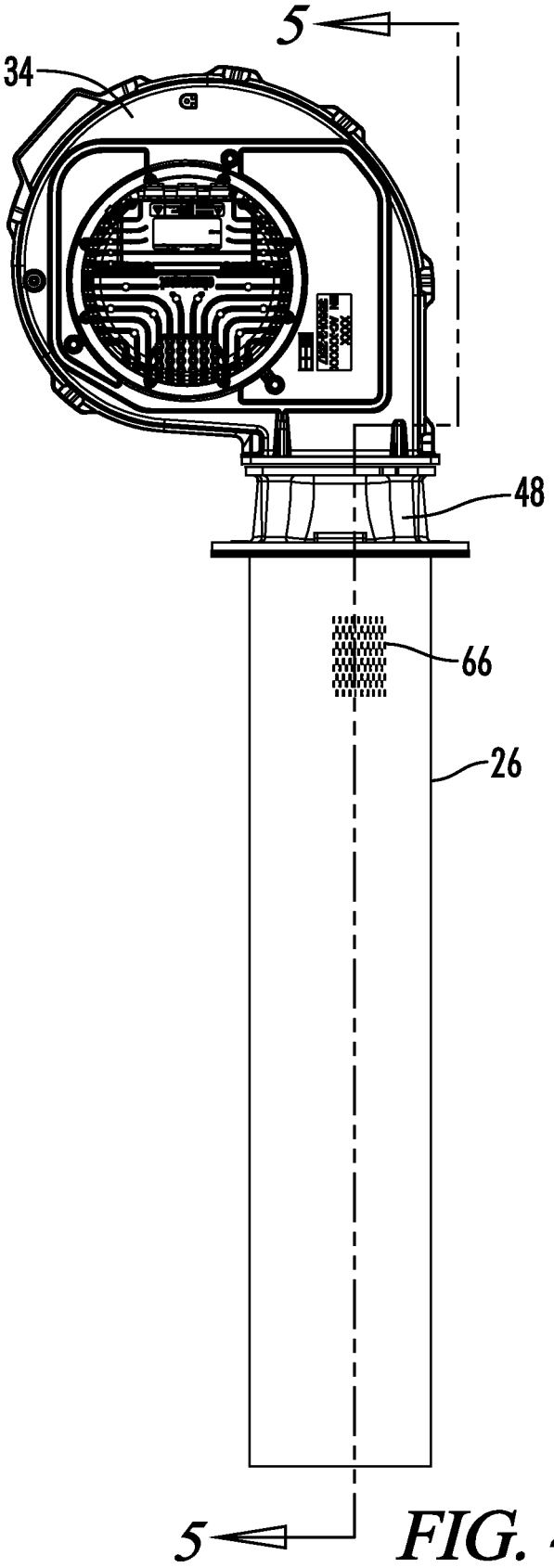
FIG. 4 is a side elevation view of the blower and burner assembly of FIG. 4.
Figure 5:
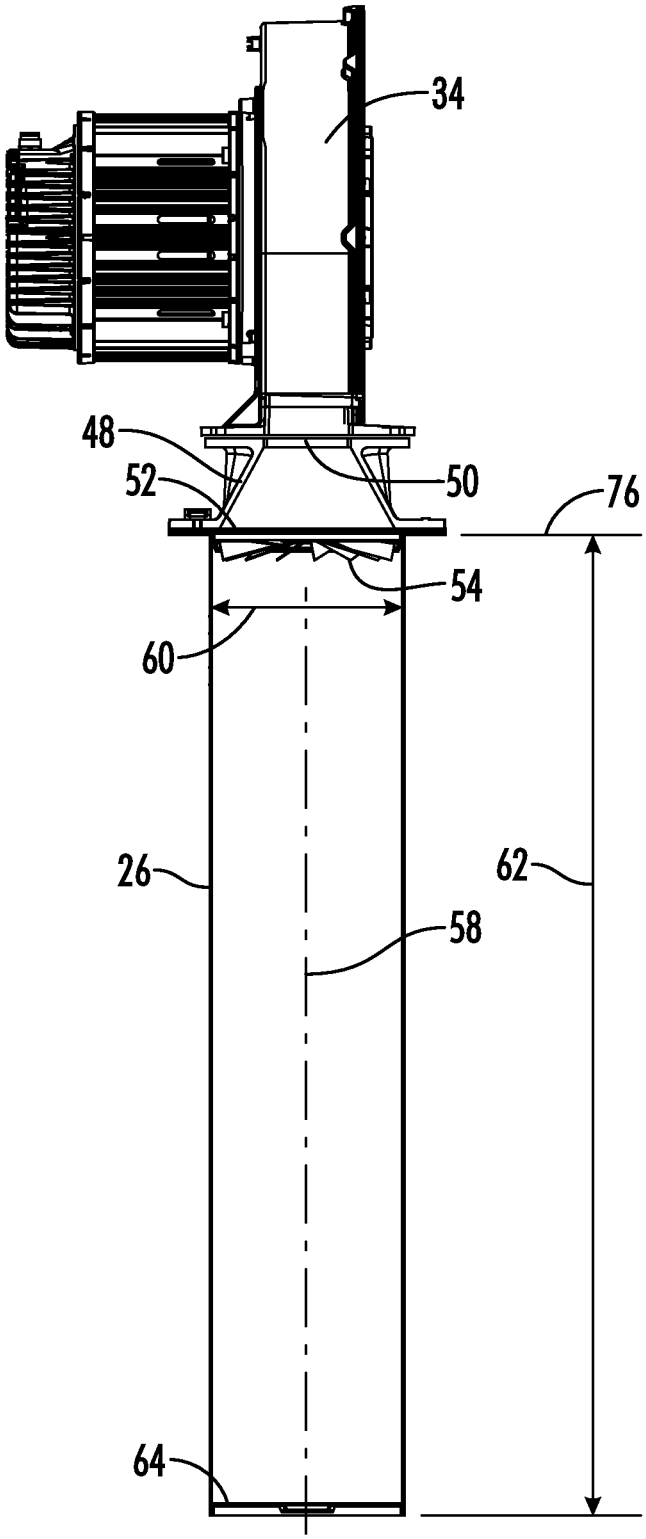
FIG. 5 is a cross sectional view taken along line 5-5 of FIG. 4 showing the cross section of the burner apparatus with a flow distribution member in place at the inlet of the burner apparatus.

As best seen in FIGS. 3-5, the burner 26 has a generally cylindrical burner outer surface 56 generally concentrically disposed about a burner central axis 58. The burner inlet 52 is a generally circular burner inlet 52 located at the upper end of the burner 26. The burner inlet 52 has an inlet diameter 60. The burner has a length 62 from the burner inlet 52 to a burner bottom 64. In the embodiment illustrated, the cylindrical outer surface 56 of the burner 26 is covered with a foraminous material such as for example wire mesh, woven wire fabric, ceramic material or the like which is generally indicated by the patch of foraminous material 66 illustrated in FIGS. 3 and 4. It will be understood that the entire cylindrical outer surface 56 will be made up of such foraminous material 66. In the embodiment shown, the bottom 64 of burner 26 is a closed non porous bottom.

Thus, as schematically illustrated in FIG. 2, generally radially outward extending flames 68 will form on the cylindrical exterior surface 56 of burner 26 and will heat the surrounding heat exchanger tubes 24.

The blower outlet 50 of blower 34 has a blower outlet which may generally be rectangular in shape, and has a blower outlet cross sectional area which may be less than the circular inlet cross sectional area of the circular inlet 52 of burner 26. This can best be appreciated by viewing the diverging enlarging cross section of the blower to burner transition duct 48 which is best seen in the cross sectional view of FIG. 5, and by viewing the superimposed rectangular blower outlet cross-section and burner inlet cross-section as seen in FIG. 11B described below.

When using a pre-mix blower such as blower 34 to supply fuel and air mixture to the cylindrical burner inlet 52, in the absence of the flow distribution member 54, the high velocity flow of fuel and air mixture exiting the blower 34 and entering the burner inlet 52 can cause a negative pressure zone at the inlet of the burner 52 and for a short distance downstream thereof, which can result in pulling flame back into the burner 26. Also, the velocity profile exiting the blower outlet 50 across the cross section thereof is typically not even and equal across the entire cross sectional area of the blower outlet 50, which can result in uneven loading of the burner 26. Furthermore, high velocity flow from the blower outlet 50 through the burner 26 can cause noisy operation of the water heater apparatus 10 under normal running conditions. This problem may be more severe in arrangements where the blower outlet 50 cross-section is substantially smaller than the burner inlet 52 cross-section. But there can be other causes of unequal velocity profile entering the burner inlet 52, such as for example the unequal distribution due to centrifugal effects within the blower 34, or flow disturbances due to ducting between the blower 34 and the burner 26. The flow distribution member 54 described herein may be used in any suitable situation, including arrangements where the cross-section of the blower outlet 50 is greater than the cross-section of the burner inlet 52.

The flow distribution member 54 is provided to break up the flow pattern of the fuel and air mixture exiting the blower outlet 50 and to redirect that fuel and air mixture into a spiral flow pattern 106 (see FIG. 10) as the fuel and air mixture flows downward through the burner 26 from the burner inlet 52 toward the burner bottom 64.

This spiral flow pattern 106 creates an outward pressure at the neck of the burner adjacent and just downstream of the burner inlet 52, and also throughout the entire burner length 62, thus causing the fuel and air mixture to exit the burner 26 at an equal or approximately equal flame velocity throughout the entire length of the burner 26, thus eliminating negative pressure zones.

Additionally, the flow distribution member 54 may eliminate the effect of blower velocity profile on the burner balancing. The inherently unequal velocity profile at the outlet 50 of the blower 34 is redirected into the spiral flow pattern 106 by the flow distribution member 54, which results in a balanced burner 24.

Finally, by breaking up the flow pattern exiting the blower outlet 50, the flow distribution member 54 reduces the noise level of the combustion system of water heater 10 during normal operation.

One preferred construction of the flow distribution member 54 is shown in more detail in FIGS. 6-9.

The flow distribution member 54 includes a closed axially central portion 70 configured to block flow of fuel and air mixture axially centrally into the burner 26 along the burner axis 58.

The flow distribution member 54 further includes a plurality of vanes 72 extending radially outward from the closed axially central portion 70. The vanes 72 are configured to generate the swirling flow 106 of fuel and air mixture flowing past the vanes 72 into the burner 26.

Figure 6:
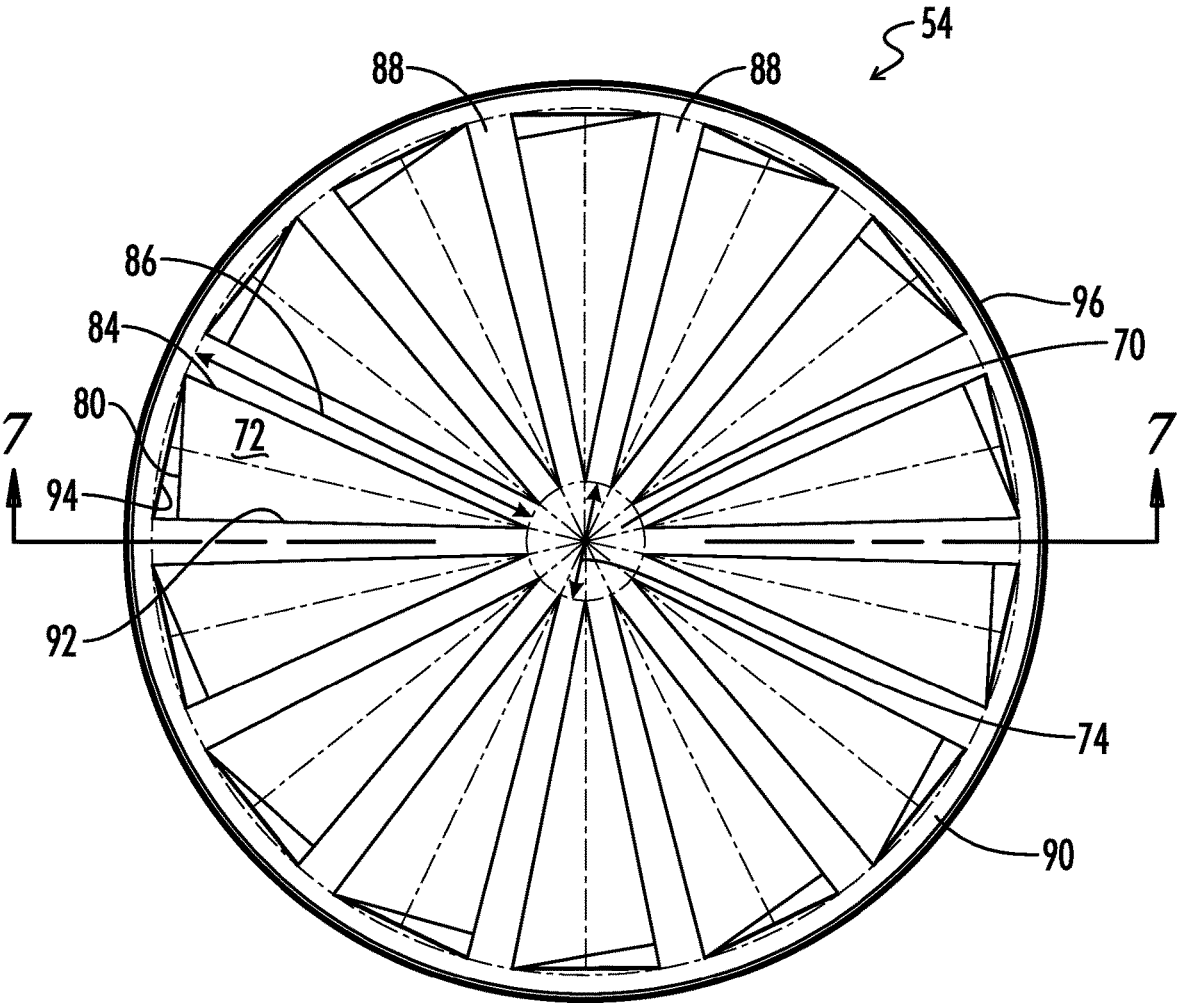
FIG. 6 is a plan view of the flow distribution member of FIG. 5.

As best shown in FIG. 6, the closed axially central portion 70 is generally disc shaped and has a disc diameter 74 in a range from about 10 percent to about 20 percent of the inlet diameter 60.

As seen in FIG. 5, the burner inlet 52 may be described as defining an inlet plane 76 generally perpendicular to the burner longitudinal axis 58. Each of the vanes 72 may be described as being oriented at a vane angle 78 best shown in FIG. 7. The vane angle 78 may be in a range from about 30 degrees to about 60 degrees, and more preferably may be in a range of from about 35 degrees to about 45 degrees. It will be appreciated that for a planar vane 72, the vane angle 78 is the angle between the plane of the vane 72 and inlet the plane 76. The angle 78 as illustrated in FIG. 7 is schematic only, and does not depict exactly the angle between the two planes.

In the embodiment illustrated, each of the vanes 72 may be described as being generally planar and as being generally triangular in shape. It will be appreciated, however, that the vanes 72 could also be curved.

In the embodiment illustrated in FIGS. 6-9, the flow distribution member 54 comprises a formed integral sheet of material such as stamped steel. The vanes 72 are each generally triangular shaped with two free sides 80 and 82 and one attached side 84, as identified in FIGS. 6 and 7. The attached side 84 can be described as extending generally radially relative to the central axis 58 of the burner 26, and may be described as defining a radial length 86 of the vane 72. The radial length 86 is preferably in a range from 40 percent to 45 percent of the inlet diameter 60.

Figure 7:
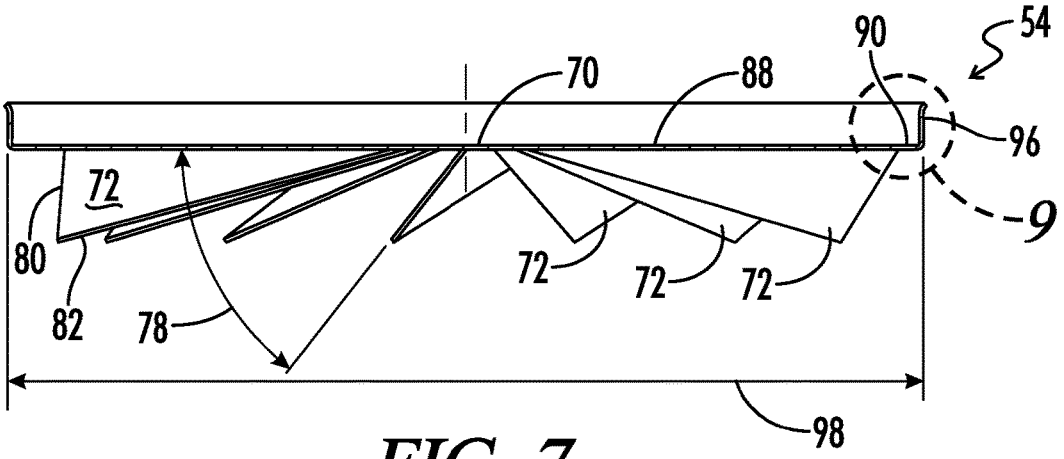
FIG. 7 is a cross section view of the flow distribution member taken along lines 7-7 of FIG. 6.
Figure 8:
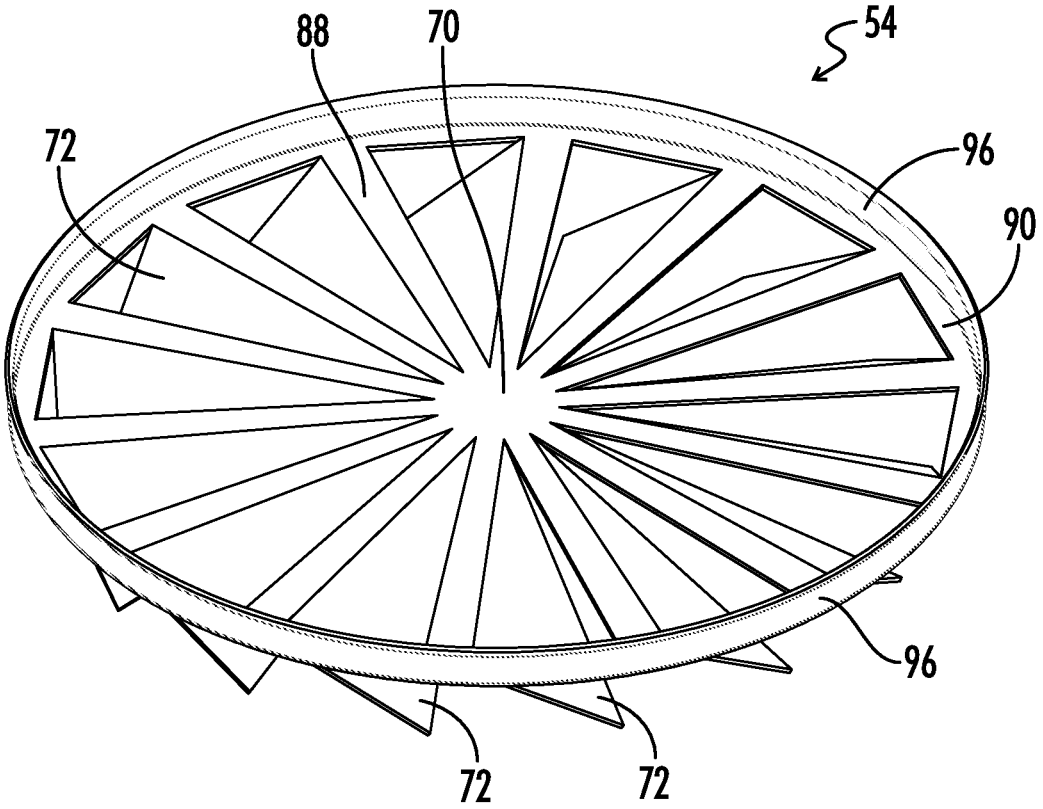
FIG. 8 is a top perspective view of the flow distribution member of FIG. 6.
Figure 9:
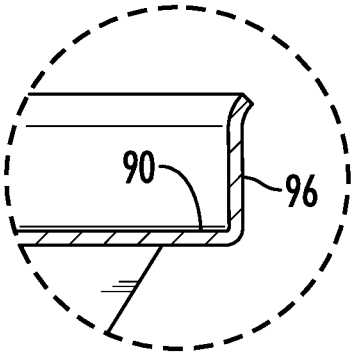
FIG. 9 is a an enlarged cross section view of the outer mounting flange portion of the flow distribution member of FIG. 6, from within the circled portion of the right hand side of FIG. 7.

In the embodiment illustrated in FIGS. 6-8, the flow distribution member 54 includes fourteen vanes 72 arranged in an array substantially equally circumferentially spaced about the central axis 58 of the burner 26. The array of vanes preferably includes at least twelve and no greater than twenty vanes 72.

The flow distribution member 54 includes a plurality of spokes 88 extending radially outward from the closed axially central portion 70, to an annular outer flange portion 90.

It will be appreciated in the view of FIG. 7, that the closed axially central portion 70, the spokes 88 and the flange portion 90 are generally planar, and that the vanes 72 have been folded out of that plane along their fixed sides 84. Each of the vanes 72 may be described as being attached to one of the spokes 88 at the attached side 84 of the vane 72.

The flow distribution member 54 may be described as having a plurality of triangular openings in the plane or cross sectional area thereof, each of which openings is defined as a triangular opening between the attached side 84, and a radially open edge 92 and an outer open edge 94. The total open area of the flow distribution member 54 is preferably in a range from about 50 percent to about 70 percent of the cross sectional area of the circular burner inlet 52. It will be appreciated that the effectiveness of this open area is also dependent upon the vane angle 78.

The flow distribution member 54 may also have a radially outward upturned annular wall 96 formed thereon for aid in placement and retention of the flow distribution member 54 in the inlet 52 of the burner apparatus 26.

EXAMPLE

One example of flow distribution member 54 has an outside diameter 98 of 7.727 inches. The closed axially central portion 70 has a disc diameter 74 of 1.0 inches. Each of the fourteen vanes 72 has a radial length 86 of 3.16 inches. Each of the first free sides 80, and the corresponding outer open edge 94 has a length of 1.25 inches. This provides a flow distribution member 54 having a total open area of approximately 58 percent of the cross sectional area of the burner inlet 52. The vanes 72 are at a vane angle 78 of approximately 40 degrees.

The flow distribution member 54 just described is designed for use with a burner 26 designed for a heat output at maximum rated capacity of 4.0 MM Btu/Hr. In general, the apparatus 10 may be described as having a heat output at maximum rated capacity in excess of 1.0 MM Btu/Hr. For the burner 26, designed to have a maximum rated capacity of 4.0 MM Btu/Hr, the inlet stream 100 may have a flow velocity of 10.4 ft/sec at the inlet 52 of the burner 26 at low fire, and 52.2 ft/sec at high fire.

The example flow distribution member 54 was tested to compare pressure distribution in the burner, both with and without the flow distribution member.

Figure 11A:
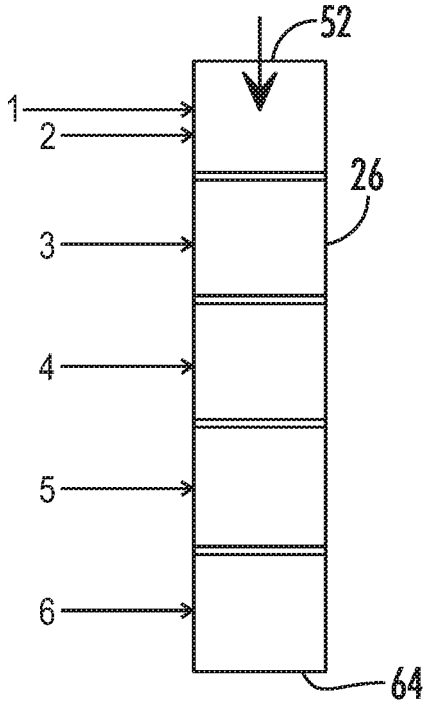
FIG. 11A is a schematic elevation view of a test setup for testing the pressure distribution within a burner without a pressure distribution member.
Figure 11B:
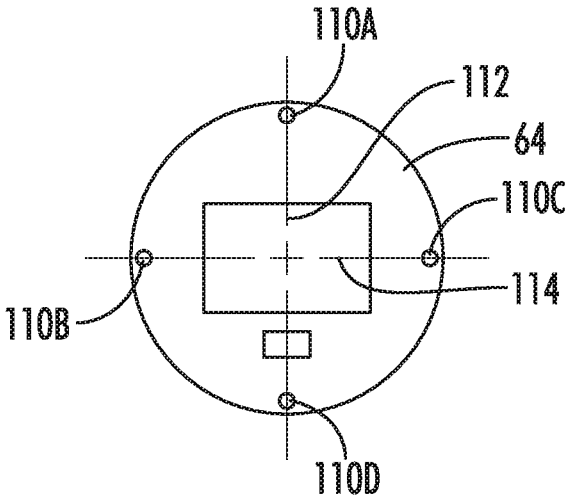
FIG. 11B is a schematic bottom view of the test setup of FIG. 11A, showing the blower outlet cross-section superimposed on the burner inlet cross-section, and showing the location of the pressure test points within the four quadrants of the cross-section of the burner inlet.

FIG. 11A is a schematic elevation view of the burner 26, identifying six axial test locations 1 through 6 along the length of the burner from its inlet 52 to its bottom 64. The burner 26 had a length 62 of 40 inches, and an inlet diameter 60 of 7.8 inches. FIG. 11B is a schematic bottom view of the burner 26, showing superimposed on the burner cross-section the location of the blower outlet 50. The blower outlet 50 had a width along centerline 112 of 3.6 inches and a length along centerline 114 of 6.7 inches. Also shown in FIG. 11B are the locations of pressure detection tubes in the four quadrants of the burner cross-section. The pressure detection tubes are inserted through the burner bottom 64 near the inside surface of the cylindrical burner so as to measure the air pressure in the burner 26 adjacent the burner wall. The pressure detection tubes 110A-D are longitudinally movable so that their open end is located at the desired one of the test elevations 1-6 seen in FIG. 11A. The locations of the pressure detection tubes also correspond to the orientation of the blower outlet 50. Pressure detection tubes 110A and 110D are aligned with the centerline 112 across the width of the cross-section of the rectangular outlet 50, and pressure detection tubes 110B and 110C are aligned with the centerline 114 across the length of cross-section of the rectangular outlet 50.

The test was performed by blowing air into the burner 26 with the blower 34 operating at 5500 RPM, and measuring the air pressure in the four quadrants of the cross-section at each of the six different elevations 1-6 along the length of the burner 26. The data is displayed in the following Table I, with the pressure data being displayed in "inches of water".

TABLE I

| Elevation Location | Distance From Burner Inlet (Inches) | Pressure Detection Tube 110D | Pressure Detection Tube 110C | Pressure Detection Tube 110B | Pressure Detection Tube 110A |
|---|---|---|---|---|---|
| 1 | 3.25 | −0.02 | 2.20 | 0.85 | 0.34 |
| 2 | 5.75 | 0.29 | 2.90 | 1.70 | 1.20 |
| 3 | 13.75 | 1.20 | 3.00 | 1.50 | 1.80 |
| 4 | 21.50 | 1.50 | 2.60 | 1.50 | 1.70 |
| 5 | 28.75 | 1.60 | 2.10 | 1.30 | 1.60 |
| 6 | 35.75 | 1.50 | 1.80 | 1.20 | 1.40 |

As is seen in Table I, very low pressures are experienced for pressure detection tube 110D at elevation locations 1 and 2, and for pressure detection tube 110A at elevation location 1. These locations correspond to the width centerline 112 of the outlet 50, and they are locations where back flow of flame into the burner could occur. Also there is a substantial lack of uniformity of the pressure data in the four quadrants for any selected elevational location near the burner inlet 52.

Figure 12A:
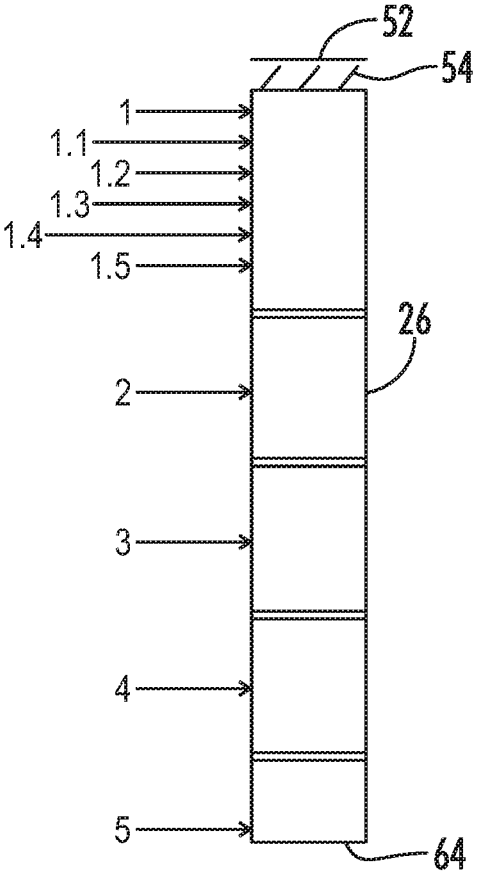
FIG. 12A is a schematic elevation of a test setup for testing the pressure distribution within a burner with the pressure distribution member.
Figure 12B:
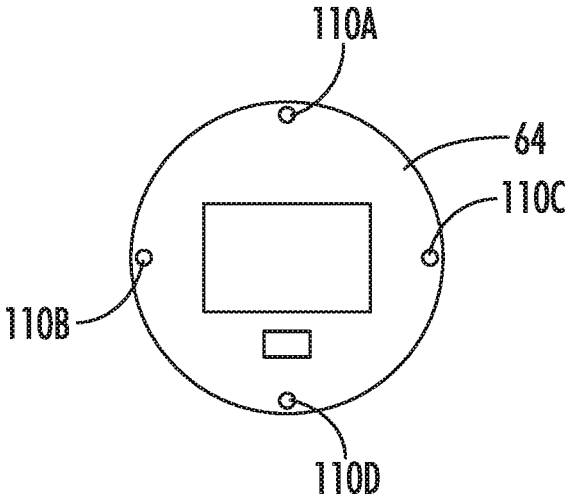
FIG. 12B is a schematic bottom view of the test setup of FIG. 12A.

FIGS. 12A and 12B are similar to FIGS. 11A and 11B, but are for the testing of the burner 26 with the flow distribution member 54, constructed as per the example described above, in place. It is noted that in the quadrants of pressure detection tubes 110D and 110A, where the low pressure problems were observed in the testing of FIGS. 11A and 11B, additional elevational test locations 1.1-1.5 were added in the upper portion of the burner 26 to further explore the pressure distribution. The test results using the flow distribution member 54 are seen in the following Table II:

TABLE II

| Elevation Location | Distance From Burner Inlet (Inches) | Pressure Detection Tube 110D | Pressure Detection Tube 110C | Pressure Detection Tube 110B | Pressure Detection Tube 110A |
|---|---|---|---|---|---|
| 1 | 3.25 | 2.90 | 1.50 | 1.70 | 2.10 |
| 1.1 | 3.75 | 2.00 | NA | NA | 2.20 |
| 1.2 | 4.25 | 1.60 | NA | NA | 2.40 |
| 1.3 | 4.75 | 1.90 | NA | NA | 2.30 |
| 1.4 | 5.25 | 1.90 | NA | NA | 2.20 |
| 1.5 | 5.75 | 2.20 | NA | NA | 2.30 |
| 2 | 13.75 | 1.40 | 1.50 | 1.80 | 1.20 |
| 3 | 21.50 | 1.20 | 1.10 | 1.10 | 1.10 |
| 4 | 28.75 | 0.97 | 0.97 | 0.90 | 0.97 |
| 5 | 35.75 | 0.72 | 0.84 | 0.75 | 0.76 |

It is noted that as compared to Table I there are much higher pressures adjacent the burner inlet 52, and there are no negative pressure zones. Also, with the use of the flow distribution member 54 there is much better cross-sectional pressure uniformity across the four quadrants for any given elevational location, as compared to the data of Table I.

CFD Modeling

Figure 13:
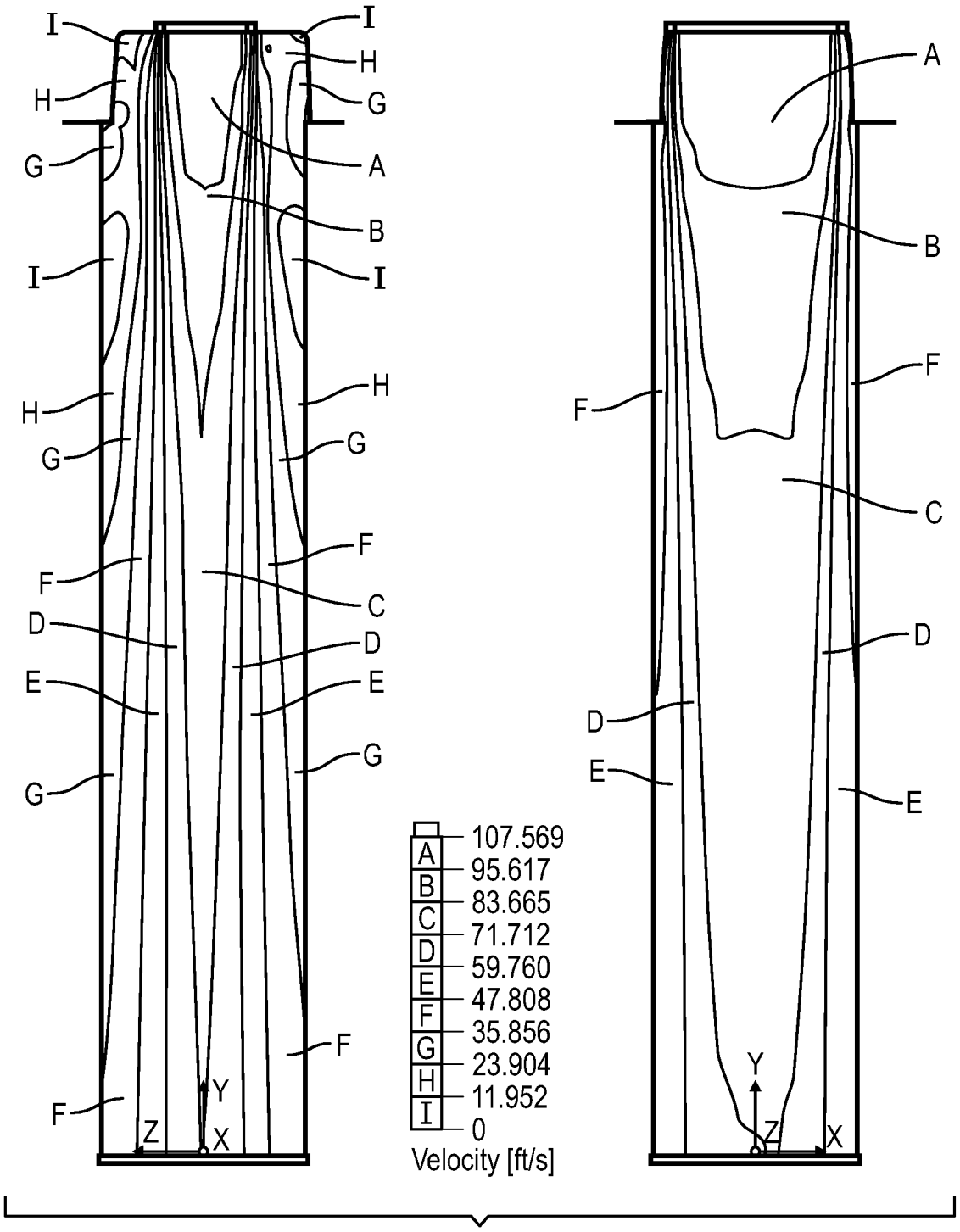
FIG. 13 is a visual depiction of the flow velocity/pressure distribution of a baseline burner without a flow distribution member, as computed using CFD (computational fluid dynamics) modeling. The left side of FIG. 13 is a cross-section along centerline 112 of the blower outlet seen in FIG. 11B. The right side of FIG. 13 is a cross-section along centerline 114 of the blower outlet seen in FIG. 11B. The table in the middle of FIG. 13 identifies flow velocity range zones A, B, C etc.
Figure 14:
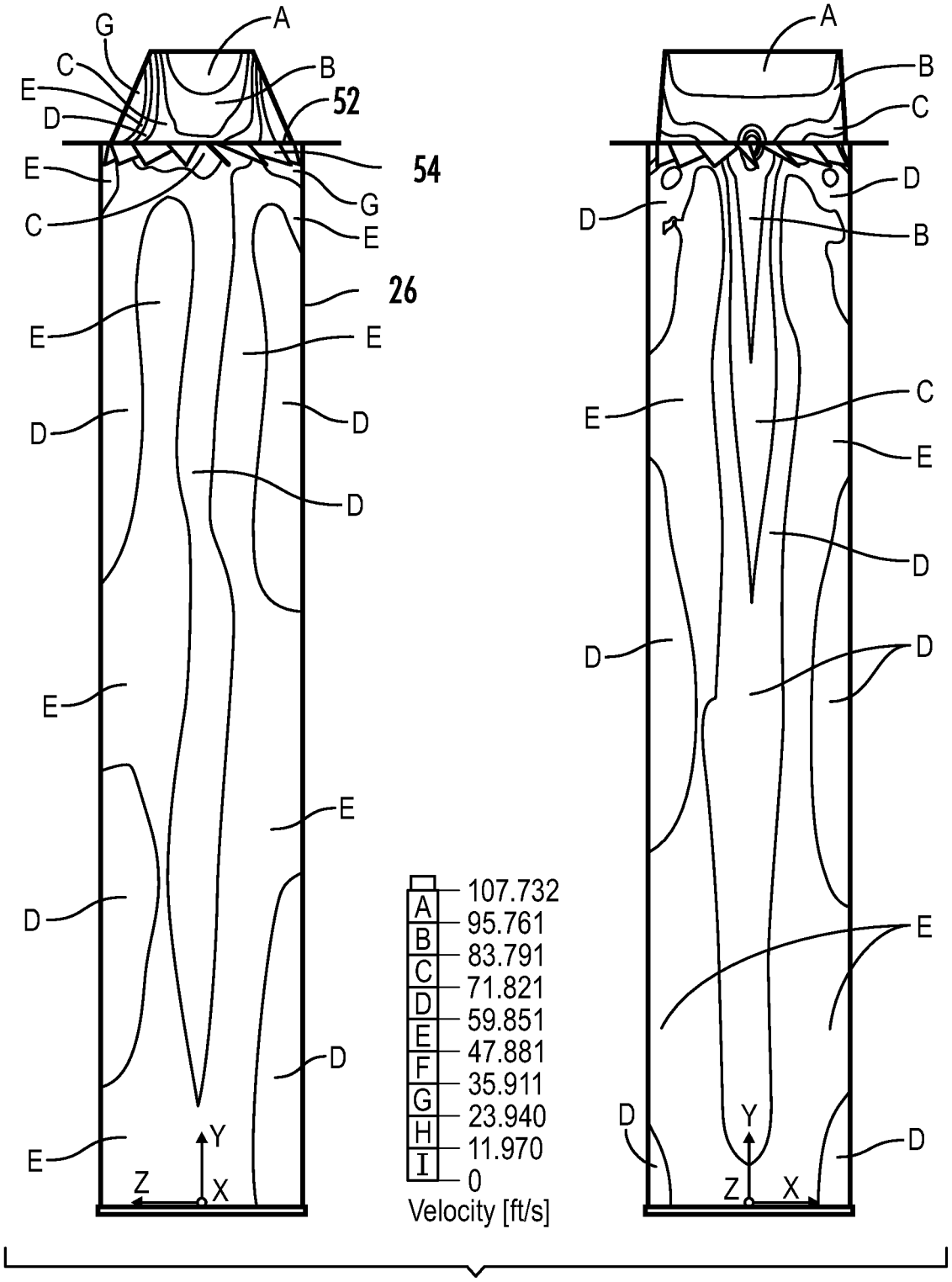
FIG. 14 is a visual depiction of the flow velocity/pressure distribution of a burner with the flow distribution member disclosed herein, as computed using CFD (computational fluid dynamics) modeling. The left side of FIG. 14 is a cross-section along centerline 112 of the blower outlet seen in FIG. 11B. The right side of FIG. 14 is a cross-section along centerline 114 of the blower outlet seen in FIG. 11B. The table in the middle of FIG. 14 identifies flow velocity range zones A, B, C etc.
Figure 15:
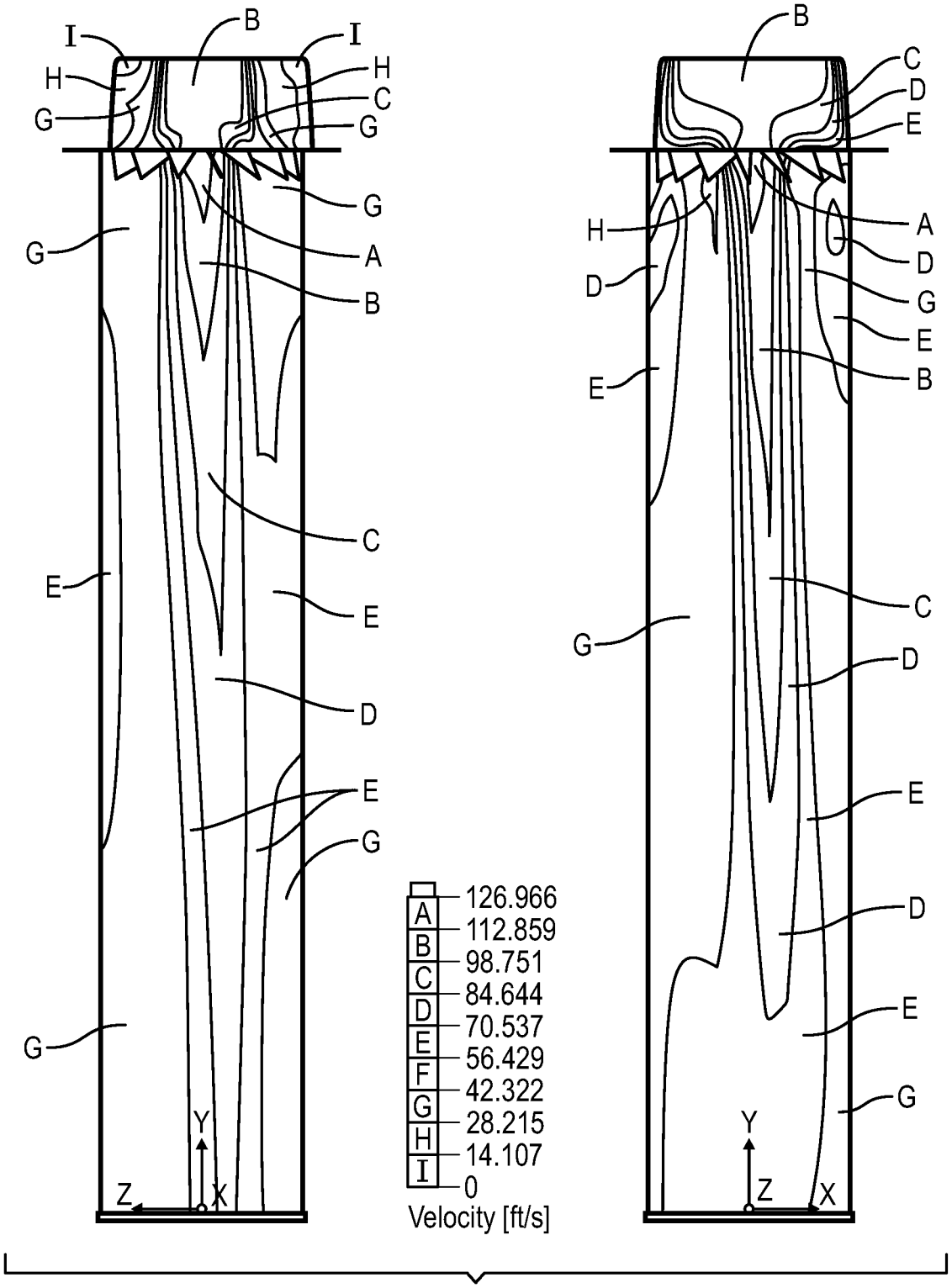
FIG. 15 is a visual depiction of the flow velocity/pressure distribution of a comparable burner having a flow distribution member with an open center instead of the closed center disclosed herein, as computed using CFD (computational fluid dynamics) modeling. The left side of FIG. 15 is a cross-section along centerline 112 of the blower outlet seen in FIG. 11B. The right side of FIG. 15 is a cross-section along centerline 114 of the blower outlet seen in FIG. 11B. The table in the middle of FIG. 15 identifies flow velocity range zones A, B, C etc.

FIGS. 13-15 represent CFD (computational fluid dynamics) modeling. FIG. 13 represents the baseline modeling that was done for the burner 26 without the flow distribution member 54. FIG. 14 represents the modeling for the burner 26 using the flow distribution member 54, having dimensions substantially like those of the example described above for the test data of FIG. 12A and 12B. FIG. 15 represents comparative CFD modeling that was done for a modified flow distribution member having an open center instead of having the closed center 70.

In FIG. 13, there are two cross-sections shown, taken along the two centerlines 112 and 114 of the rectangular cross-section of the blower outlet 50 seen in FIG. 11B. The cross-section on the left side of FIG. 13, is taken along the shorter centerline 112, and the cross-section on the right side of FIG. 13 is taken along the longer centerline 114. Between the two cross-sectional views of FIG. 13 there is a table showing zones of computed flow velocities, which correspond also to fluid pressure. Thus the zone indicated as "A" represents velocities in the range of from 107.732 ft/s down to 95.761 ft/s. Corresponding areas in the cross-sectional views having velocities within that range have been identified by the tag lines with the letter "A". Similar identification is provided for zones of flow velocity B, C, etc. By comparison it is apparent that there is more lack of uniformity of flow velocities along the axis 112 than along the axis 114. This is because there is a greater discontinuity between the cross-sectional shape of the blower outlet 50 and the burner inlet 52 along axis 112. As can be seen on the cross-section on the left side of FIG. 13, there are significant areas having very low velocities in the I, H and G velocity zones, which are representative of low pressure or negative pressure areas where flash back could occur. It is apparent that these problematic areas are located along the centerline 112 across the narrow width of the blower outlet 50.

FIG. 14 is presented in a format similar to FIG. 13, and is representative of a burner 26 including the flow distribution member 54 having a closed center 70 as described herein. Again, the cross-section on the left side of FIG. 14 is taken along centerline 112, and the cross-section on the right side of FIG. 14 is taken along centerline 114. In both cross-sections the flow velocities are much more uniform in all four quadrants at a given cross-section, than were the results of FIG. 13. Also there are no low or negative pressure zones near the burner inlet 52.

Finally, FIG. 15 is presented to contrast the performance of the flow distribution member 54 having the closed center portion 70, to a flow distribution member having similar radial vanes but having an open center instead of the closed center 70. As is apparent, there is a very high axial velocity stream near the inlet 52 surrounded by some relatively low velocity zones near the inlet 52. There is a great lack of uniformity of flow velocities across each cross-section, especially near the burner inlet 52. The flow distribution member modeled in FIG. 15 creates very low flow velocities near the burner surface adjacent the burner inlet 52, and under certain conditions such a design could suffer from flash back of flames into the burner.

Methods of Operation

Figure 10:
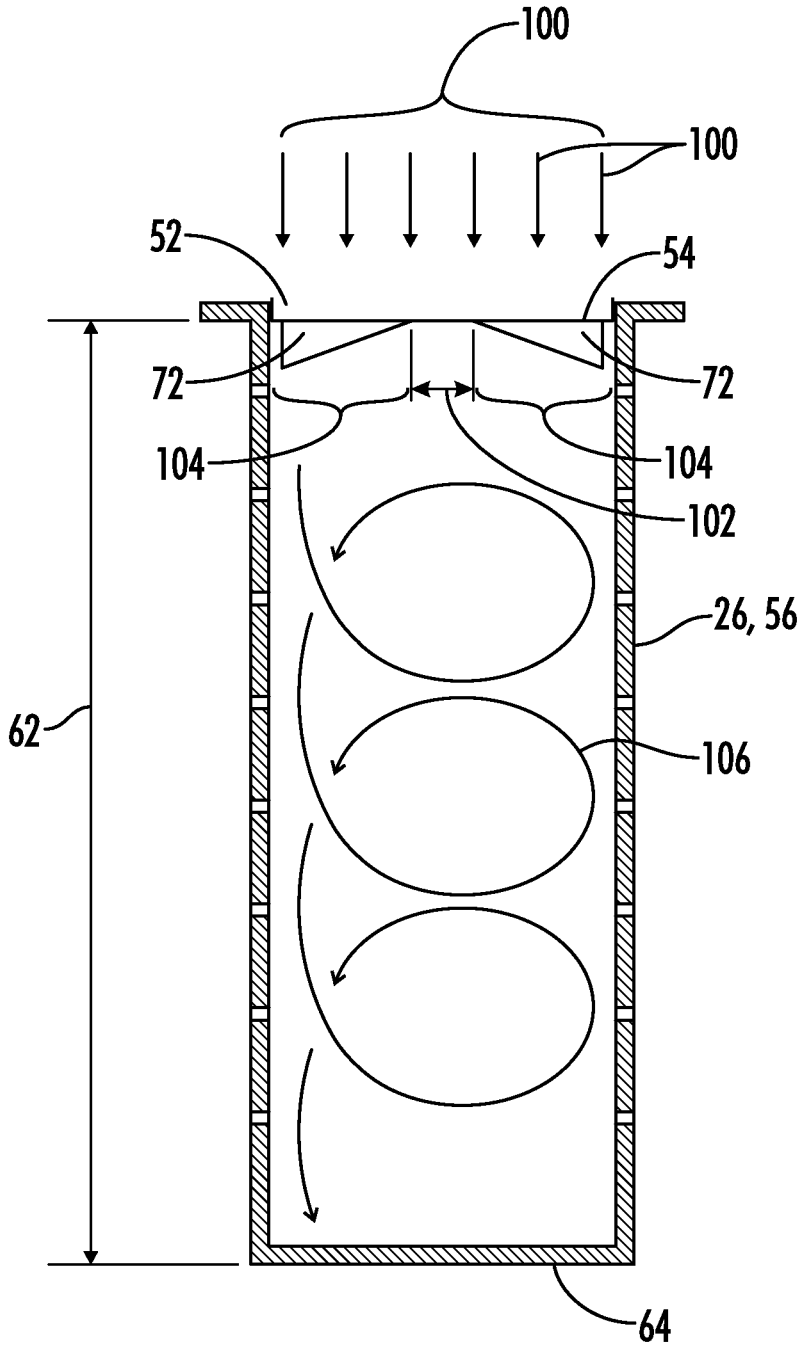
FIG. 10 is a schematic cross-section view of the burner showing the spiral flow pattern downstream of the flow distribution member.

The methods of operating the burner apparatus 26 may be described as follows with reference to the schematic illustration of FIG. 10.

An inlet stream 100 of fuel and air mixture is provided to the inlet 52 of burner 26 from the outlet 50 of blower 34 via the blower to burner transition duct 48.

An axially central portion 102 of inlet 52 is blocked by the closed axially central portion 70 of flow distribution member 54 thereby preventing axially central flow of the inlet stream 100 into the inlet 52.

This diverts the inlet stream 100 through an annular area 104 between the axial central portion 102 and the outside diameter 60 of the burner inlet 52. Additionally, the vanes 72 swirl the inlet stream 100 as it passes across the vanes 72 thus creating the spiral flow pattern schematically illustrated at 106 in FIG. 10. The spiral flow pattern 106 extends along the entire length 62 of the burner 26.

As a result of the spiral flow pattern 106 and the absence of axially central flow adjacent the inlet 52 to burner 26, negative pressures are avoided along the entire length 62 of the burner 26, particularly adjacent the burner inlet 52.

Furthermore, the spiral flow pattern 106 causes the fuel and air mixture to exit the burner outer surface 56 at substantially uniform velocities along the entire length 62 of the burner 26.

The vanes 72 serve as a directional guide to the fuel and air mixture. The angle 78 of the vanes 72 can vary, but should be great enough to create a swirling motion of the fuel and air mixture to form the spiral flow pattern 106.

With the spiral flow pattern 106, an outward pressure is provided against the perforated burner wall 56 which in turn provides an even and substantially equal flame pattern throughout the length 62 of the burner 26.

Thus it is seen that the apparatus and methods of the present invention readily achieve the ends and advantages mentioned, as well as those inherent therein. While certain preferred embodiments of the invention have been illustrated and described for purposes of the present disclosure, numerous changes in the arrangement and construction of parts and steps may be made by those skilled In the art, which changes are encompassed within the scope and spirit of the present invention as defined by the appended claims.

What is claimed is:

1. A pre-mix burner apparatus, comprising:

a fuel and air mixer for pre-mixing a fuel and air mixture;

a blower located downstream of the fuel and air mixer, the blower including a blower outlet having a blower outlet cross-sectional area;

a burner having a generally cylindrical burner surface so that generally radially outward extending flames may form on the generally cylindrical burner surface, the burner having a central axis and having a generally circular burner inlet at one end of the burner, the burner inlet having an inlet diameter defining an inlet cross-sectional area greater than the blower outlet cross-sectional area;

the blower and the burner being arranged such that the blower outlet spans the central axis of the burner and is oriented to direct an inlet stream of fuel and air mixture along the central axis of the burner; and a flow distribution member arranged to distribute flow of fuel and air mixture from the blower outlet into the burner, the flow distribution member including:

a closed axially central portion configured to block flow of the inlet stream of fuel and air mixture axially centrally into the burner; and a plurality of vanes extending radially outward from the closed axially central portion, the vanes being configured to generate a swirling flow of fuel and air mixture about the central axis of the burner and flowing through the vanes into the burner.

2. The apparatus of claim 1, wherein:

the closed axially central portion is disc shaped and has a disc diameter in a range of from about 10% to about 20% of the inlet diameter.

3. The apparatus of claim 1, wherein:

the burner inlet defines an inlet plane generally perpendicular to the burner central axis; and each of the vanes is oriented at a vane angle to the inlet plane in a range of from about 30 degrees to about 60 degrees.

4. The apparatus of claim 3, wherein:

each of the vanes is planar.

5. The apparatus of claim 3, wherein:

each of the vanes is generally triangular.

6. The apparatus of claim 3, wherein:

each of the vanes has a radial length in a range of from about 40% to about 45% of the inlet diameter.

7. The apparatus of claim 1, wherein:

the plurality of vanes includes at least twelve and no greater than twenty vanes substantially equally circumferentially spaced about the central axis of the burner.

8. The apparatus of claim 1, wherein:

the flow distribution member comprises a formed integral sheet, the vanes each being generally triangular shaped with two free sides and one attached side, the attached side extending generally radially relative to the central axis of the burner.

9. The apparatus of claim 1, wherein:

the flow distribution member has a total open area in a range of from about 50% to about 70% of a cross-sectional area of the burner inlet.

10. The apparatus of claim 1, wherein:

the flow distribution member includes a plurality of spokes extending outward from the closed axially central portion, each of the vanes being attached to one of the spokes.

11. The apparatus of claim 10, wherein:

the flow distribution member includes a radially outer planar flange connected to radially outer ends of the spokes, the flange being configured to mount the flow distribution member.

12. The apparatus of claim 1, wherein:

the vanes are configured such that the spiral flow pattern adjacent and downstream of the burner inlet prevents flame flow back into the burner adjacent the burner inlet.

13. The apparatus of claim 1, in combination with a water heater, the water heater being in heat exchange relationship with the burner.

14. A method of operating a burner having a generally cylindrical burner surface so that generally radially outward extending flames may form on the generally cylindrical burner surface, the burner having a central axis and having a generally circular burner inlet at one end of the burner, the burner inlet having an inlet diameter defining an inlet cross-sectional area, the method comprising:

(a) premixing a fuel and air mixture upstream of a blower;

(b) providing an inlet stream of the fuel and air mixture to the burner inlet from the blower, the blower having a blower outlet with an outlet cross-section with a cross-sectional area less than the inlet cross-sectional area of the burner inlet, wherein the blower outlet cross-section overlies the central axis of the burner and is centered on the central axis so that the inlet stream of fuel and air mixture is directed along the central axis;

(c) blocking an axially central portion of the inlet and thereby preventing axially central flow of the inlet stream into the inlet; and (d) swirling the inlet stream and creating a spiral flow pattern as the stream passes through an annular area between the axially central portion and a diameter of the burner inlet, such that negative pressure is avoided in the burner adjacent the burner inlet.

15. The method of claim 14, wherein:

the burner has an axial length; and in step (d) the spiral flow pattern extends along the entire axial length of the burner.

16. The method of claim 15, wherein:

the spiral flow pattern causes the fuel and air mixture to exit the burner surface at substantially uniform velocities along the entire axial length of the burner.

17. The method of claim 15, wherein:

the spiral flow pattern avoids the creation of negative pressures at any location along the entire axial length of the burner.

18. The method of claim 14, wherein:

the burner is operated at an output in excess of 1.0 MM BTU/HR.

19. The method of claim 14, further comprising:

heating water with a heat exchanger in heat exchange relationship with the burner.

* * * * *